US005216475A

United States Patent [19]

Ohno

[11] Patent Number: 5,216,475

[45] Date of Patent: Jun. 1, 1993

[54] PULLEY DRIVEN IMAGE FORMING APPARATUS

[75] Inventor: Akio Ohno, Yokohama, Japan

[73] Assignee: Canon Kabushika Kaisha, Tokyo, Japan

[21] Appl. No.: 843,159

[22] Filed: Feb. 28, 1992

[30] Foreign Application Priority Data

Mar. 4, 1991 [JP] Japan ..... 3-037413
Jan. 8, 1992 [JP] Japan ..... 4-001570

[51] Int. Cl.[5] ..... G03G 15/01

[52] U.S. Cl. ..... 355/326; 355/200; 355/271

[58] Field of Search ..... 355/200, 210, 211, 212, 355/213, 326, 327, 271; 346/157; 474/69, 84–86

[56] References Cited

U.S. PATENT DOCUMENTS

| | | | |
|---|---|---|---|
| 4,522,483 | 6/1985 | Matsumoto et al. | 355/211 X |
| 4,531,828 | 7/1985 | Hoshino | 355/327 X |
| 4,549,803 | 10/1985 | Ohno et al. | 355/284 |
| 4,690,542 | 9/1987 | Furuta et al. | 355/327 |
| 4,803,515 | 2/1989 | Hoshino et al. | 355/271 |
| 5,091,751 | 2/1992 | Inoue et al. | 355/274 |
| 5,111,242 | 5/1992 | Tanimoto et al. | 355/271 X |

FOREIGN PATENT DOCUMENTS 2185938 8/1987 United Kingdom ..... 355/200

*Primary Examiner*—A. T. Grimley
*Assistant Examiner*—William J. Royer
*Attorney, Agent, or Firm*—Fitzpatrick, Cella, Harper & Scinto

[57] ABSTRACT

An image forming apparatus has at least one image carrier, a device for forming a latent image on the image carrier at a latent image forming position, a device for developing the latent image on the image carrier at a developing position, and a device for transferring the developed image on the image carrier onto an image receiving member. The apparatus features a drive source, and image carrier pulley connected to each of the at least one image carriers, a drive pulley connected to the drive source, and a device for transmitting a driving force from the drive pulley to each image carrier pulley. The time taken to rotate each of the at least one image carriers from the image forming position to the transfer position is substantially equal to an integer multiple of the time taken to make one revolution of the drive pulley.

13 Claims, 8 Drawing Sheets

PULLEY DRIVEN IMAGE FORMING APPARATUS

BACKGROUND OF THE INVENTION

1. Field of the Invention

This invention relates to an image forming apparatus for forming an image on a recording medium.

2. Description of the Prior Art

In conventional image forming apparatuses based on an electrophotography system, an electrophotographic sensitive medium provided as an image carrier is charged by a charging device, and is irradiated with light in accordance with image information to form a latent image. This latent image is developed by a development device, and the developed image is transferred onto a sheet member or the like to form a recorded image.

Image forming apparatuses for forming color images are in demand. A type of image forming apparatus has therefore been proposed which has a plurality of image carriers each independently used with the above-described image forming process to form a full-color image. In such an apparatus, a yellow image, a magenta image, a cyan image and, preferably, a black image are formed on the image carriers and these color images are transferred at respective image carrier transfer positions to a sheet member so as to be superposed on each other.

This type of image forming apparatus is advantageous in terms of speeding recording since it has image forming sections each independently operated with a respective color. It is also adaptable for use with a particular sheet member such as a thick sheet or a transparent sheet, but entails a problem relating to suitably registering color images formed in different image forming sections. This registration is important because a misalignment of the positions of images in one or more of the four colors transferred onto the sheet member appears finally as a color misalignment or a change in color tone.

An apparatus having a plurality of photosensitive drums driven with one drive source has been disclosed to solve this problem (see U.S. Pat. No. 4,803,515). In this apparatus, the distances between photosensitive drums is selected to equalize the time interval at which a sheet member passes the photosensitive drums to an integer multiple of the period of a driving non-uniformity cycle of a drive source such as a driving motor. Consequently, the phases of deviations from the correct positions at the image forming sections due to driving non-uniformity are equalized, thereby preventing color misalignment. This arrangement is very effective in preventing color misalignment.

The present invention is an improvement on this type of apparatus and features pulleys to stabilize the drive meshing to improve the effect of limiting color misalignment.

SUMMARY OF THE INVENTION

An object of the present invention is to provide an image forming apparatus capable of forming a clear image.

Another object of the present invention is to provide a high-quality color image free from color misalignment.

Still another object of the present invention is to provide an image forming apparatus capable of forming a high-quality image by preventing image expansion/-contraction.

A further object of the present invention is to provide an image forming apparatus capable of forming a high-quality image, free from registration errors and color misalignments when the image is formed by superposing images in different colors on each other.

In accordance with the above objects, there is provided in one aspect of the invention an image forming apparatus having at least one image carrier, means for forming a latent image on the image carrier at a latent image forming position, means for developing the latent image on the image carrier at a developing position, and means for transferring the developed image on the image carrier onto an image receiving member. The apparatus comprises a drive source, an image carrier pulley connected to each of the at least one image carriers, a drive pulley connected to the drive source, and means for transmitting a driving force from the drive pulley to each image carrier pulley. The time taken to rotate each of the at least one image carriers from the image forming position to the transfer position is substantially equal to an integer multiple of the time taken to make one revolution of the drive pulley.

In another aspect of the invention, there is provided an image forming apparatus having a plurality of image carriers, means for forming a latent image on each image carrier at a latent image forming position, means for developing a latent image on each image carrier at a developing position, and means for transferring a developed image on each image carrier onto an image receiving member. The apparatus comprises a drive source, and image carrier pulley connected to each of the image carriers, a drive pulley connected to the drive source, and means for transmitting a driving force from the drive pulley to each image carrier pulley. Each image carrier is driven so that the time taken to rotate the image carrier from the latent image forming position to the transfer position is substantially equal to an integer multiple of the time taken to make one revolution of the drive pulley.

In yet another aspect of the invention, there is provided an image forming apparatus having at least one image carrier, means for forming a latent image on the image carrier at a latent image forming position, means for developing the latent image on the image carrier at a developing position, and means for transferring the developed image on the image carrier onto an image receiving member. The apparatus comprises drive means comprising an image carrier pulley connected to an end of the image carrier, a drive pulley for driving said image carrier pulley, and a belt stretched between the image carrier pulley and the drive pulley. The drive means drives the image carrier so that the time taken to move the image carrier from the latent image forming position to the transfer position is substantially equal to an integer multiple of the time taken to make one revolution of the second pulley.

In still another aspect of the invention, there is provided an image forming apparatus having a plurality of image forming stations, each image forming station having one of a plurality of image carriers, means for forming a latent image on the image carrier at a latent image forming position, means for developing a latent image on the image carrier at a developing position, and means for transferring the developed image on the image carrier onto an image receiving member. The apparatus comprises a drive means comprising a plurality of image carrier pulleys, each connected to an end of one image carrier, a drive pulley for driving the image carrier pulleys, and a belt stretched between each image carrier pulley and the drive pulley. The drive means drives each image carrier so that the time taken to rotate the image carrier from the latent image forming position to the transfer position is substantially equal to an integer multiple of the time taken to make one revolution of the drive pulley; and images are superimposed on the image receiving member at each image forming station.

DESCRIPTION OF THE PREFERRED EMBODIMENTS

Preferred embodiments of the present invention will be described below with reference to the accompanying drawings.

The embodiments described below comprise an image forming apparatus having an image carrier, a means for forming a latent image on the image carrier, a means for developing the latent image, a means for transferring the developed image on the image carrier onto an image receiving member, and a drive means including an image carrier pulley provided on an end of the image carrier, a drive pulley for driving the first pulley and a belt stretched between the image carrier pulley and the drive pulley. The drive means drives the image carrier so that the time taken to move the image carrier from the latent image forming position to the transfer position is approximately equal to an integer-multiplied multiple of the time taken to make one revolution of the drive pulley. Further, a plurality of image carriers are provided to form a plurality of image forming stations, and each are driven in this manner.

An image forming apparatus to which the present invention can be applied will first be described below with reference to FIG. 3.

Figure 3:
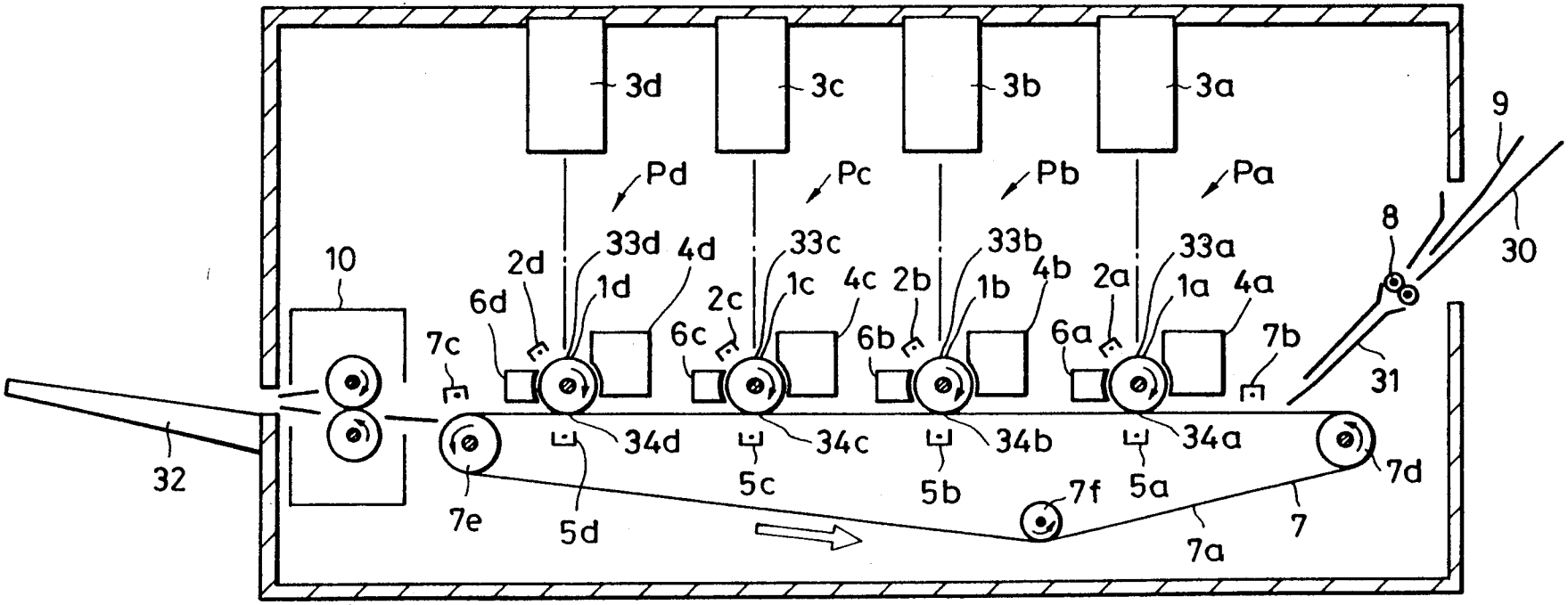
FIG. 3 is a schematic cross-sectional view of an image forming apparatus in accordance with the present invention.

The image forming apparatus shown in FIG. 3 has four image forming stations Pa, Pb, Pc, and Pd, and the image forming stations Pa, Pb, Pc, and Pd have image carriers provided by photosensitive drums 1*a*, 1*b*, 1*c*, and 1*d*, respectively. Around these drums are respectively disposed charging means 2*a*, 2*b*, 2*c*, and 2*d*, exposure means 3*a*, 3*b*, 3*c*, and 3*d* such as laser scanners for irradiating the photosensitive drums with light in accordance with image information, development means 4*a*, 4*b*, 4*c*, and 4*d*, transfer means 5*a*, 5*b*, 5*c*, and 5*d*, and cleaning means 6*a*, 6*b*, 6*c*, and 6*d*. A yellow image, a magenta image, a cyan image, and a black image are formed at the image forming stations Pa, Pb, Pc, and Pd, respectively.

A transport means 7, using an endless belt, is disposed below the photosensitive drums 1*a* to 1*d* so that the endless belt is stretched through the image forming stations Pa to Pd. An image receiving member such as a sheet member 9 formed of paper or the like supplied from a sheet supply tray 30 by a sheet feed roller 8 is led to the transport means 7 by a guide 31 and is transported over the transfer means 5*a* to 5*d* of the image forming stations Pa to Pd by the transport means 7. The transport means 7 has an electrostatic attraction belt 7*a*, a charging device 7*b* for charging the belt 7*a*, and a charge removing device 7*c* for removing charge from the belt 7*a*. The sheet member 9 is transported while being attracted to the belt 7*a* by an electrostatic attraction force.

In this image forming apparatus, a latent image in yellow component color in accordance with image information is formed on the photosensitive drum 1*a* by a well-known electrophotography processing means including the charging means 2*a* and exposure means 3*a* of the first image forming station Pa. The latent image is thereafter made into a visible yellow toner image by the development means 4*a* with a developer having a yellow toner, and the yellow toner image is transferred by the transfer means 5*a* onto the sheet member 9 transported by the transport means 7.

While the yellow toner image is being transferred onto the sheet member 9, a latent image in magenta component color is formed at the second image forming station Pb. A toner image is then formed by the development means 4*b* with a magenta toner, and the magenta toner image is transferred onto the sheet member 9 by the transfer means 5*b* of the image forming station Pb, when the sheet member has been transported to this station after the completion of transfer at the first image forming station Pa.

Cyan and black images are subsequently formed in the same manner. After the toner images in the four colors have been superposed on each other on the sheet member 9, the sheet member 9 is heated by the fixation means 10 to fix these images, thereby obtaining a multicolor or full color image on the sheet member 9.

Residual toners are removed by the cleaning means 6*a* to 6*d* from the photosensitive drums 1*a* to 1*d* from which the images have been transferred to prepare for the next image formation to be effected subsequently. Components 7*d*, 7*e*, and 7*f* are rollers, and a component 32 is a discharge tray.

A method of driving the photosensitive drums in this image forming apparatus will be described below with reference to FIGS. 1 and 2.

Figure 1:
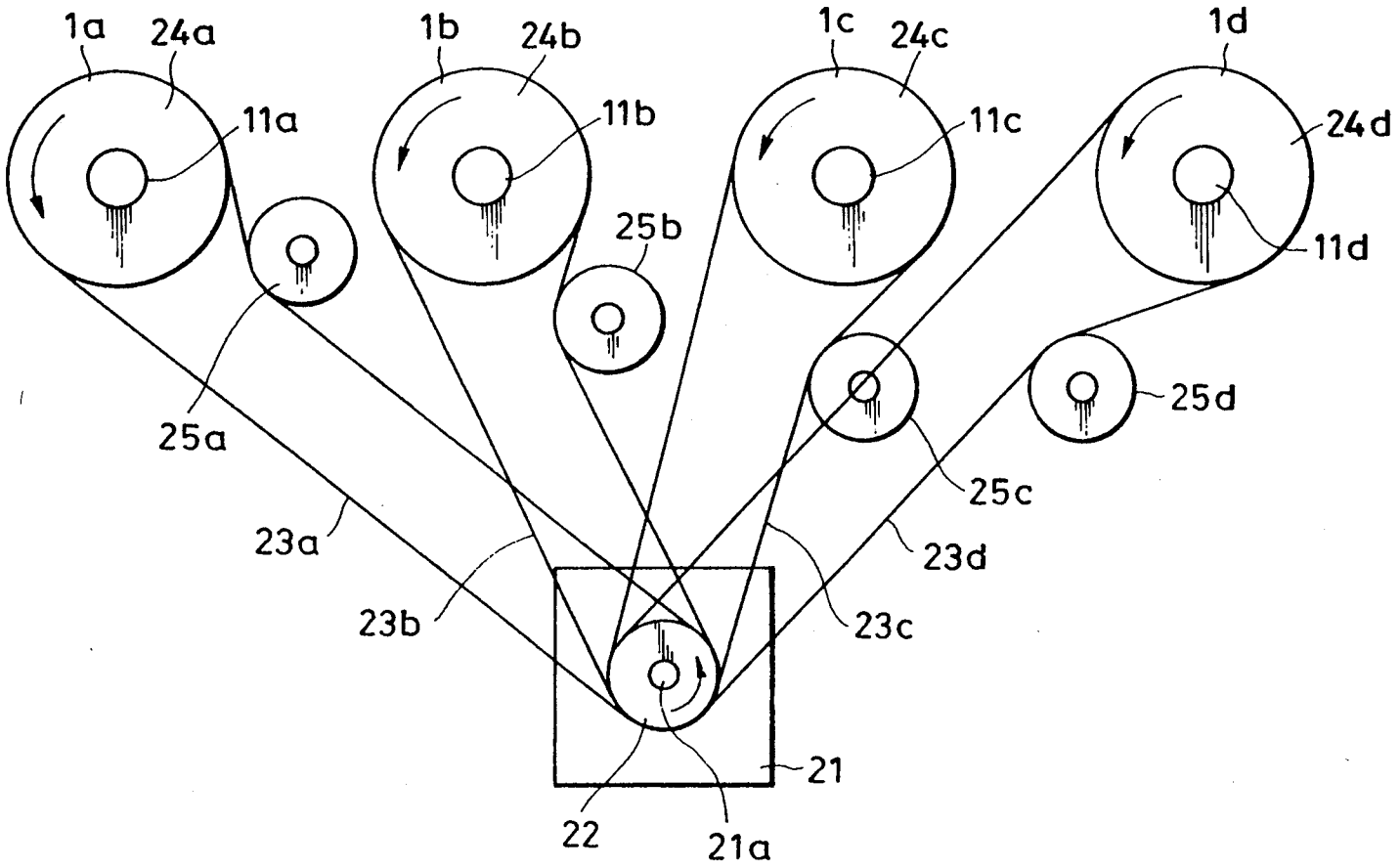
FIG. 1 is a schematic diagram of an apparatus for driving image carriers in accordance with a first embodiment of the present invention.

Referring to FIG. 1, the photosensitive drums 1*a*, 1*b*, 1*c*, and 1*d* of the four image forming stations described above with reference to FIG. 3 are supported by drum shafts 11*a*, 11*b*, 11*c*, and 11*d*, respectively. Image carrier pulleys 24*a*, 24*b*, 24*c*, and 24*d* are fixed on the drum shafts 11*a*, 11*b*, 11*c*, and 11*d*, respectively. Driving forces are transmitted from a driving motor 21 to the drum shafts 11*a* to 11*d* through a drive pulley 22, timing belts 23*a*, 23*b*, 23*c*, and 23*d* providing means for transmitting a driving force, and the image carrier pulleys 24a to 24d, to drive the corresponding photosensitive drums. Idler pulleys 25a to 25d serve to adjust the tensions of the timing belts 23a to 23d. The timing belts 23a to 23d are toothed belts which mesh with the teeth of the image carrier pulleys 24a to 24d.

Figure 2:
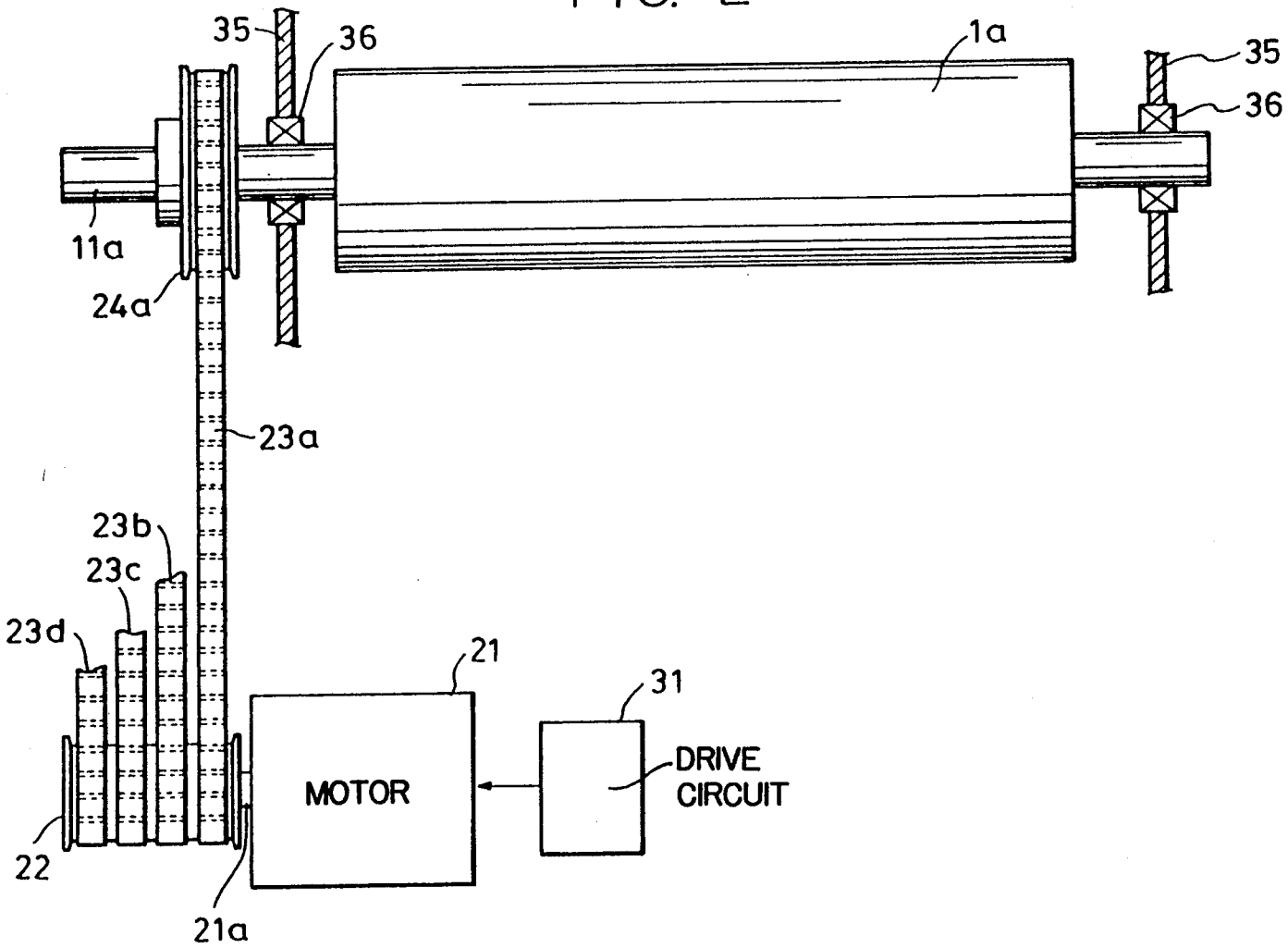
FIG. 2 is a plan view of one of the image carriers around which a timing belt is wrapped.

FIG. 2 schematically shows the photosensitive drum 1a and other components arranged along the longitudinal direction thereof in one image forming station Pa shown in FIG. 1. A component 35 is a drum support side plate and a component 36 is a drum shaft bearing.

The drive pulley 22 is fixed on an output shaft 21a of the motor 21, and the timing belts 23a to 23d are wrapped around the drive pulley 22 parallel to each other. Accordingly, the image carrier pulleys 24a to 24d on the drum shafts 11a to 11d are disposed at different positions in the longitudinal direction of the drums so as to face the belts 23a to 23d.

In the arrangement shown in FIG. 2, the timing belts are arranged in the order of 23a, 23b, 23c and 23d from the root portion of the output shaft 21a of the motor 21. However, this arrangement is not exclusive and the belt arrangement order may be selected irrespective of the basic construction of the apparatus.

The driving motor 21 is driven by a drive circuit 31 so as to rotate at a constant speed. For example, if a DC motor incorporating an encoder is used as the driving motor 21, a phase-lock control is effected by the drive circuit 31 to rotate the motor 21 at a constant speed. If a stepping motor is used as the driving motor 21, pulses are supplied from a stepping motor circuit 31 to the stepping motor in accordance with a constant clock to rotate the motor at a constant speed.

However, the accuracy with which the motor 21 is rotated at a constant speed is limited and, in the case of a DC motor, there is a possibility of occurrence of non-uniformity of rotation according to the precision of gears in the gear head, play in the gear head, the rigidity of the gear head, motor control characteristics including response, and other factors. Rotation non-uniformity may also be caused by an eccentricity of the drive pulley 22 provided on the output shaft of the motor 21.

Figure 4:
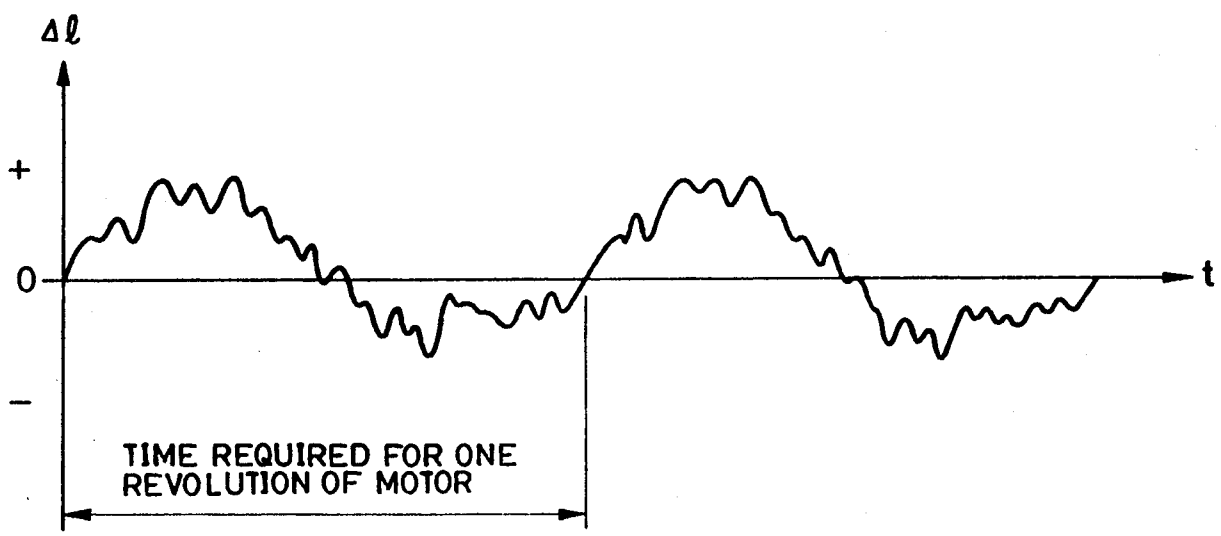
FIG. 4 is a graph of non-uniformity of rotation of a driving motor.

FIG. 4 shows an example of a waveform obtained by integrating non-uniformity of the rotation of the motor 21. The abscissa represents time t and the ordinate represents a rotation amount error Δl. This integrated rotation non-uniformity waveform has a maximum cycle corresponding to one revolution of the output shaft of the motor 21 and appears as combined short-cycle waveforms corresponding to reduction gears and other factors of the motor. A rotation amount error caused by this motor rotation non-uniformity appears as a positional error on the photosensitive drums 1a–1d. Moreover, the latent image forming step and the transfer step are influenced by non-uniformity of the rotation of the motor 21 at different times on the photosensitive drum.

Therefore, motor rotation non-uniformity causes an exposure deviation in the latent image forming step, and a transfer deviation in the transfer step. The exposure deviation and the transfer deviation may synergistically increase or cancel each other depending upon the period of the rotation of the motor 21.

In the apparatus in accordance with the above-described embodiment of the present invention, this phenomenon is utilized so that an exposure deviation and a transfer deviation cancel each other and cause no positional error on the resulting image.

That is, in the apparatus in accordance with the above-described embodiment of the present invention, the time taken to rotate the photosensitive drum from the latent image forming position to the transfer position is approximately equal to an integer multiple of the time required for one revolution of the motor 21 or the drive pulley 22, preferably equal to this time.

In this embodiment, as shown in FIG. 3, each of exposure positions 33a, 33b, 33c, and 33d, corresponding to the latent image forming position at which the corresponding photosensitive drum is irradiated with light in accordance with the image information signal, is shifted from the transfer position 34a, 34b, 34c, or 34d by 180° on the photosensitive drum. Accordingly, if the number of revolutions of each photosensitive drum is 20 rpm, the ratio of the numbers of teeth in each of the image carrier pulleys 24a–24d and the drive pulley 22 is set to 2:1 and the number of revolutions of the motor 21 is set to 40 rpm. Further, the ratio of the diameters of the pulley 22 and each of the pulleys 24a–24d may be set to 1:2.

If the exposure positions 33a–33d on each photosensitive drums 1a–1d are spaced apart from their respective transfer positions 34a–34d by e.g., about 165° the ratio of the numbers of teeth of each of the image carrier pulleys 24a–24d and the drive pulley 22 may be set to 360:165. For example, the numbers of teeth of each of the pulleys 24a–24d and the pulley 22 may be set to 72 and 33, respectively. In this arrangement, if the peripheral speed of one photosensitive drum is increased by non-uniformity of motor 21 rotation during exposure on the photosensitive drum, an image written thereon is elongated. At the time of transfer, the peripheral speed of the photosensitive drum is again increased with a delay corresponding to one cycle of the motor, that is, the transfer portion of the photosensitive drum is moved faster than the sheet member, so that the image is transferred while being contracted. Consequently, the influence of motor 21 rotation non-uniformity upon the resulting image formed on the sheet member is removed by the effect of the elongation at the time of exposure and the contraction at the time of transfer.

Figure 5A:
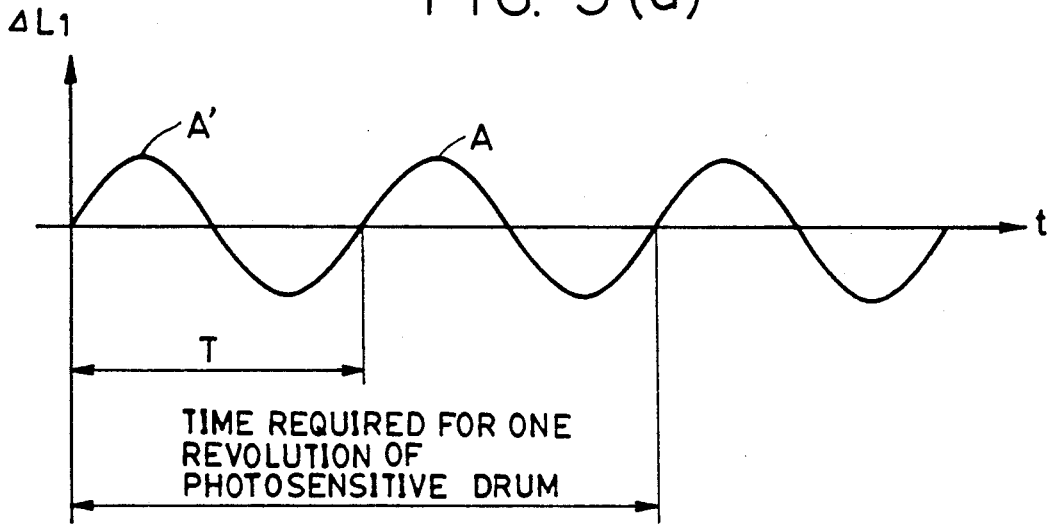
FIGS. 5(*a*), 5(*b*), and 5(*c*) are graphs of a relationship between an exposure deviation and a transfer deviation in the case of an embodiment of the present invention.
Figure 5B:
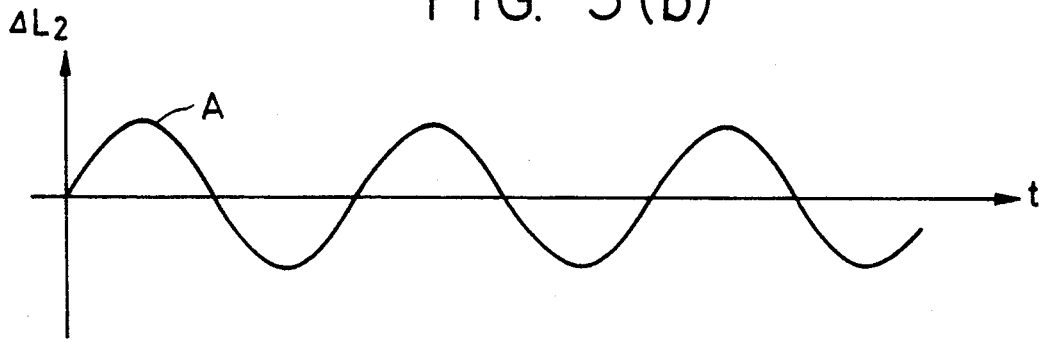
Figure 5C:
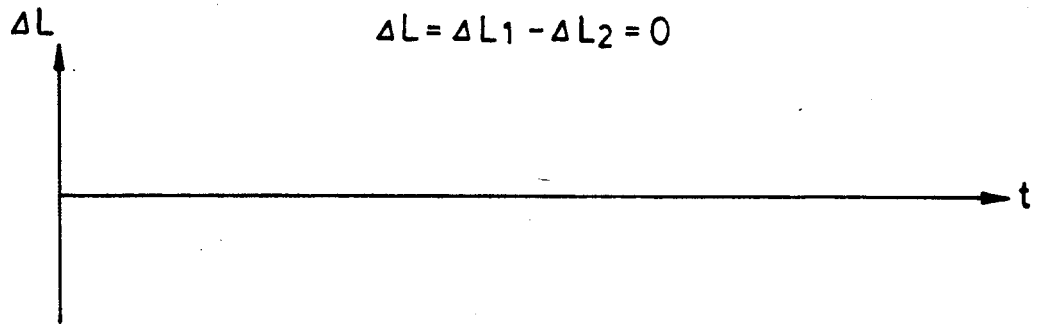

FIGS. 5(a) to 5(c) are graphs showing the effect of cancelling the exposure deviation and the transfer deviation.

In FIG. 5(a), $\Delta L_1$ represents an exposure deviation caused by motor rotation non-uniformity. It is assumed that with respect to time t on the abscissa $\Delta L_1$ forms a sine wave in a cycle having a period T corresponding to one revolution of the motor. In FIG. 5(b), {$L_2$ represents a transfer deviation caused by motor rotation non-uniformity. $\Delta L_2$ forms a waveform which is obtained by shifting the phase of $\Delta L_1$ by the angular difference between the exposure position and the transfer position on the photosensitive drum, i.e., one motor revolution period T. Accordingly, an image exposed at A' on the time base t is transferred at A. At this time, a positional error ΔL in the image transferred onto the sheet member is expressed by $\Delta L = \Delta L_1 - \Delta L_2$, so that $\Delta L = 0$, as shown in FIG. 5(c).

Figure 6A:
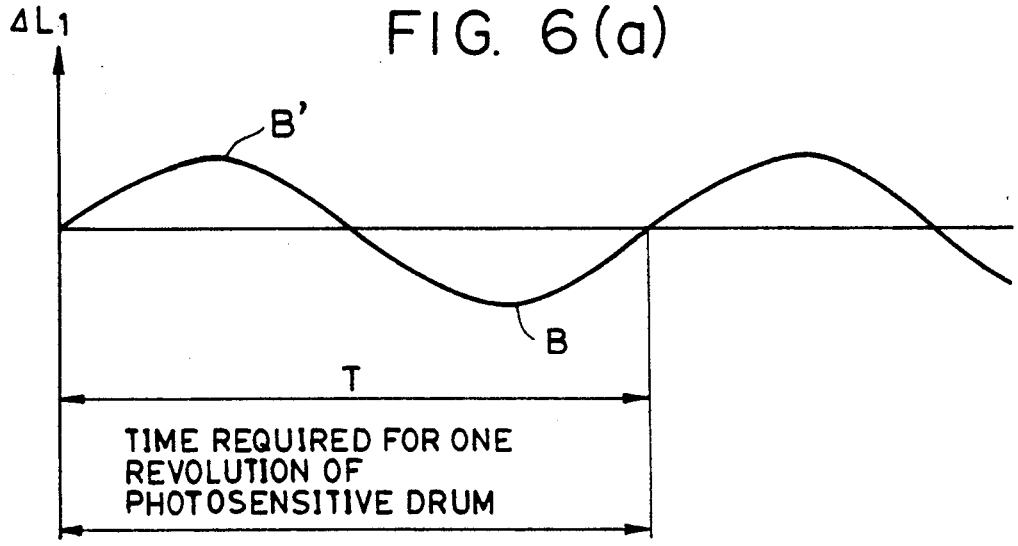
FIGS. 6(*a*), 6(*b*), and 6(*c*) are graphs of a relationship between an exposure deviation and a transfer deviation in the case of an arrangement for comparison with the embodiment of the present invention.
Figure 6B:
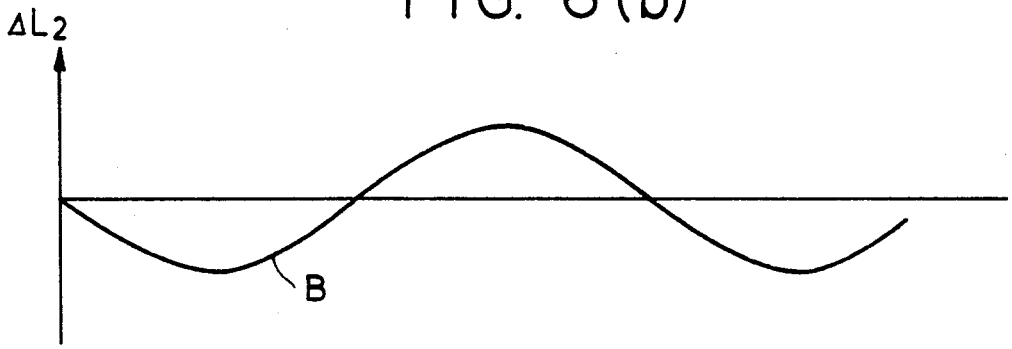
Figure 6C:
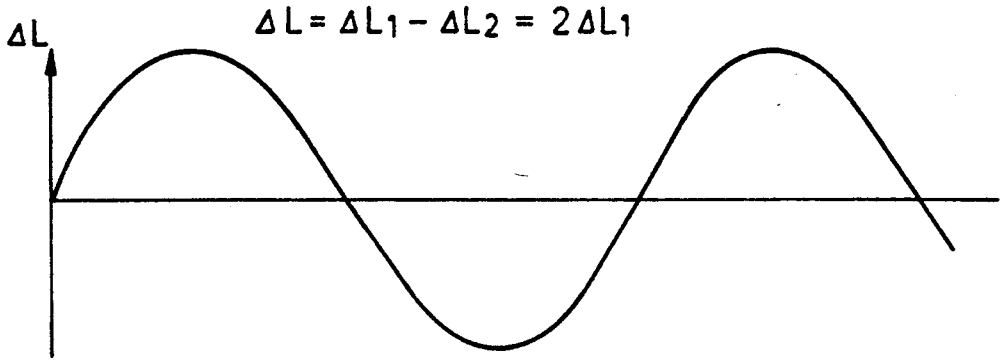

A case where exposure deviation $\Delta L_1$ and transfer deviation $\Delta L_2$ synergistically increase each other will be described below as a comparative example with reference to FIGS. 6(a) to 6(c).

In this example, the pulley ratio of the image carrier pulley 24 and the drive pulley 22 is 1:1, and the period of photosensitive drum cycles and one motor revolution period T are equal to each other. In this case, an image contracted by an exposure deviation is further contracted by a transfer deviation, and the extent of positional error caused by motor rotation non-uniformity is therefore doubled, as shown in FIG. 6(*c*).

It is therefore possible in the present invention to obtain an image free from motor rotation non-uniformity and, hence, such a positional error, by driving the photosensitive drum as shown in FIGS. 5(*a*) to 5(*c*).

In a first embodiment, the timing belts 23*a* to 23*d* are independently stretched between the drive pulley 22 and the image carrier pulleys 24*a* to 24*d*. This is intended to prevent rotation non-uniformity factors including load changes at the image forming stations from influencing each other between the image forming stations.

Figure 7:
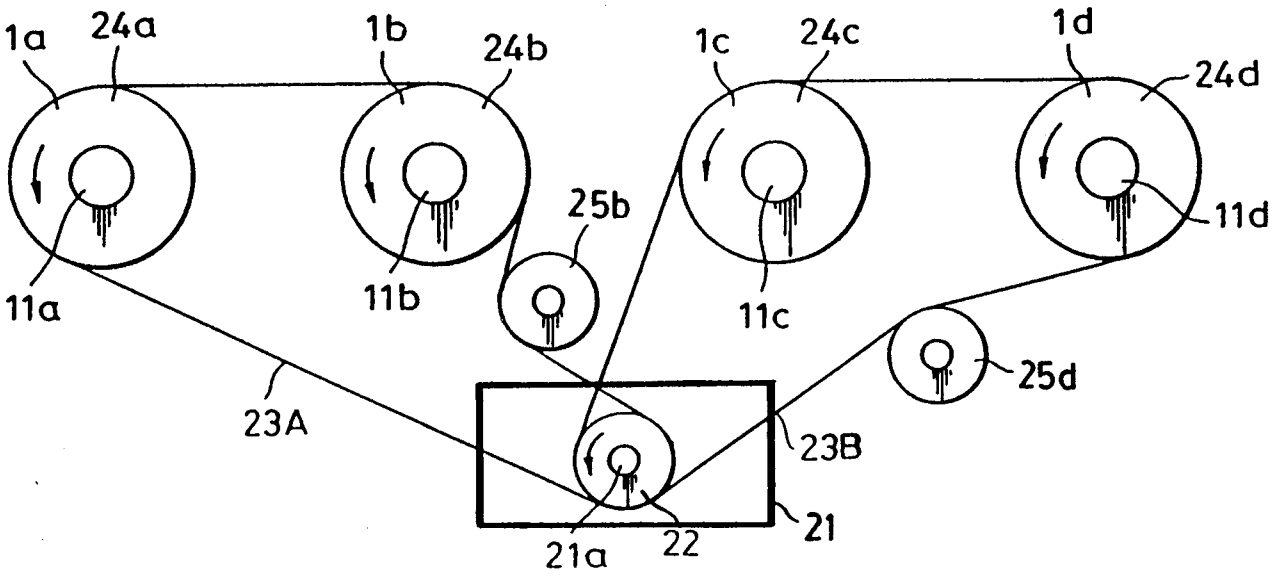
FIG. 7 is a schematic diagram of a belt driving transfer apparatus comparable with that for the first embodiment.

In a second embodiment, the driving system may alternatively be such that as shown in FIG. 7, where four image forming stations are driven with two timing belts 23A and 23B so that two stations are driven with one belt. In this system, the image carrier pulleys 24*a* and 24*b* are driven with one belt and the image carrier pulleys 24*c* and 4*d* are driven with one other belt. The rotation of the image carrier pulley 24*a* is therefore influenced by the image carrier pulley 24*b* and, conversely, the image carrier pulley 24*b* is influenced by the image carrier pulley 24*a*. The image carrier pulleys 24*c* and 24*d* also influence each other.

In the first embodiment, however, if a factor of the rotation of one of the image carrier pulleys 24*a*–24*d* fluctuates, it must, influence the other image carrier pulleys only via the driving motor 21, so that the extent of this influence is very small. It is therefore preferable to stretch the timing belts independently with respect to the image carrier pulleys as in the first embodiment.

While the timing belts are stretched independently, the period of revolutions of the idler pulleys 25*a* to 25*d* for adjusting the tensions of the timing belts 23*a* to 23*d* is equal to the period of revolutions of the drive pulley 22. Therefore, an increase in the extent of rotation non-uniformity due to the idler pulleys 25*a* to 25*d* does not appear as an image position error as described above.

Figure 8:
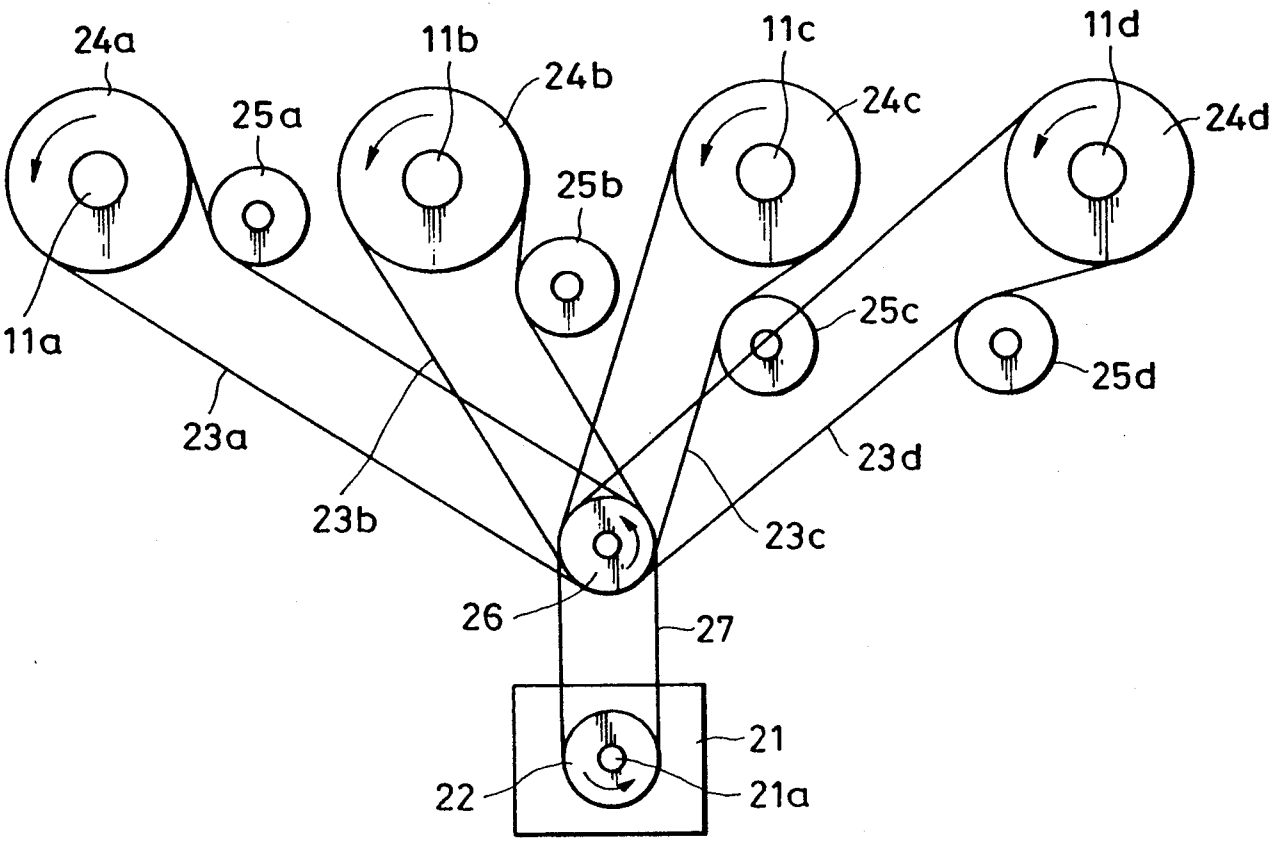
FIG. 8 is a schematic diagram of an apparatus for driving image carriers in accordance with a second embodiment of the present invention.

FIG. 8 shows a third embodiment of the present invention in which the timing belts 23*a* to 23*d* are not directly stretched from the image carrier pulleys 24*a* to 24*d* of the image forming stations to the drive pulley 22 on the output shaft 21*a* of the motor 21. In this embodiment, the torque of the motor is transmitted to a relay driving pulley 26 and the timing belts 23*a* to 23*d* are independently stretched between the relay driving pulley 26 and the image carrier pulleys 24*a* to 24*d*.

In this case, it is necessary to set the time required for one revolution of the relay driving pulley 26 to an integer multiple of the time required for one revolution of the drive pulley 22.

The driving torque is transmitted from the motor 21 to the relay driving pulley 26 through a timing belt 27. Alternatively, a different transmission means such as a gear mechanism may be used to transmit the driving torque. In this third embodiment, the periods of revolutions of the drive pulley 22 and the relay driving pulley 26 may be set in accordance with the above-described relationship to obtain the same advantages described with respect to the first embodiment.

In the above-described embodiments, a combination of timing belts and pulleys is used. Alternatively, a combination of flat belts and pulleys or gear trains may constitute a driving means.

A full-color image forming apparatus having a plurality of image carriers has been described with respect to the embodiments. However, the present invention can, of course, be applied to a monochromatic or multicolor image forming apparatus having one image carrier.

In accordance with the above-described embodiments, the torque for driving an image carrier can be transmitted so that non-uniformity of the rotation of the drive source does not appear as a positional error in image formation. In the case of an image forming apparatus having a plurality of image forming stations, therefore, a high-quality image free from an image position error and color misalignment can be obtained.

Also, in accordance with the above-described embodiments, non-uniformity of the rotation of the drive source does not appear as an image position error, and there is therefore no need to greatly improve the accuracy of the rotation of the driving motor, i.e., the drive source and the driving transmission means. The ease of production of the driving motor and the driving transmission means is therefore improved while the manufacturing cost is reduced.

In accordance with the present invention, as described above, a high-quality color image free from color misalignment can be obtained.

While the present invention has been described with respect to what presently are considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus having a plurality of image carriers, means for forming a latent image on the image carriers at latent image forming positions, means for developing the latent images on the image carriers at developing positions, and means for transferring the developed images on the image carrier onto an image recording medium, said apparatus comprising:

a drive source;

an image carrier pulley connected to each of the plurality of image carriers;

a drive pulley connected to the drive source; and means for transmitting a driving force from said drive pulley to each of said plurality of image carrier pulleys;

wherein the time taken to rotate each of the plurality of image carriers from the image forming position to a transfer position is substantially equal to an integer multiple of the time taken to make one revolution of said driving pulley.

2. An image forming apparatus according to claim 1, wherein said means for transmitting a driving force from said drive pulley to said image carrier pulley is a toothed belt.

3. An image forming apparatus according to claim 1, wherein said plurality of image carriers comprises an image carrier for forming a yellow image, an image carrier for forming a magenta image, an image carrier for forming a cyan image, and an image carrier for forming a black image, and wherein said drive source serves to drive and rotate each image carrier.

4. An image forming apparatus according to claim 1, further comprising fixation means for fixing on said image recording medium the image transferred from the image carrier onto the image recording medium.

5. An image forming apparatus according to claim 1, wherein said plurality of image carriers form images in different colors, wherein a yellow image, a magenta image, a cyan image and a black image are formed on respective image carriers and the color images are transferred at respective image carrier transfer positions to the recording medium so as to be superposed on each other to form a full-color image.

6. An image forming apparatus according to claim 1, wherein the recording medium comprises a sheet of paper.

7. An image forming apparatus having a plurality of image carriers, means for forming a latent image on each image carrier at a latent image forming position, means for developing a latent image on each image carrier at a developing position, and means for transferring a developed image on each image carrier onto an image receiving member, said apparatus comprising:

a drive source;

a plurality of image carrier pulleys each connected to one of the image carriers;

a drive pulley connected to the drive source; and means for transmitting a driving force from said drive pulley to each image carrier pulley;

wherein each image carrier is driven so that the time taken to rotate the image carrier from the latent image forming position to a transfer position is substantially equal to an integer multiple of the time taken to make one revolution of said drive pulley.

8. An image forming apparatus having a plurality of image carriers, means for forming a latent images on the image carriers at latent image forming positions, means for developing the latent images on the plurality of image carriers at developing positions, and means for transferring the developed images on the plurality of image carriers onto an image receiving member, said apparatus comprising:

drive means comprising a plurality of image carrier pulleys, each connected to an end of one of the plurality of image carriers, a drive pulley for driving said plurality of image carrier pulleys, and a belt stretched between said image carrier pulleys and said drive pulley;

wherein said drive means drives the plurality of image carriers so that the time taken to move the plurality of image carriers from the latent image forming position to a transfer position is substantially equal to an integer multiple of the time taken to make one revolution of said drive pulley.

9. An image forming apparatus according to claim 8, further comprising an idler pulley provided between said image carrier pulley and said drive pulley to control the tension of said belt stretched therebetween, wherein the period of revolution of said idler pulley is substantially equal to the period of revolution of said drive pulley.

10. An image forming apparatus having a plurality of image forming stations, each image forming station having one of a plurality of image carriers, means for forming a latent image on the image carrier at a latent image forming position, means for developing a latent image on the image carrier at a developing position, and means for transferring the developed image on the image carrier onto an image receiving member, said apparatus comprising:

drive means comprising a plurality of image carrier pulleys, each connected to an end of one image carrier, a drive pulley for driving said image carrier pulleys, and a belt stretched between each image carrier pulley and said drive pulley;

wherein said drive means drives each image carrier so that the time taken to rotate the image carrier from the latent image forming position to a transfer position is substantially equal to an integer multiple of the time taken to make one revolution of said drive pulley; and wherein images are superimposed on the image receiving member at each image forming station.

11. An image forming apparatus according to claim 10, further comprising an idler pulley provided between each of said image carrier pulleys and said drive pulley to control the tension of said belts stretched therebetween, wherein the period of revolution of said idler pulleys is substantially equal to the period of revolution of said drive pulley.

12. An image forming apparatus according to claim 10, wherein said drive pulley is a single pulley for driving all of said image carrier pulleys, and wherein a plurality of belts are each independently stretched between said drive pulley and one of said image carrier pulleys.

13. An image forming apparatus according to claim 12, further comprising an idler pulley provided between each of said image carrier pulleys and said drive pulley to control the tension of the belts stretched therebetween, wherein the period of revolution of said idler pulleys is substantially equal to the period of revolution of said drive pulley.

* * * * *

UNITED STATES PATENT AND TRADEMARK OFFICE

CERTIFICATE OF CORRECTION

PATENT NO. : 5,216,475

DATED : June 1, 1993

INVENTOR(S) : OHNO

It is certified that error appears in the above-indentified patent and that said Letters Patent is hereby corrected as shown below:

On the Title Page, Item [57]:
Line 9, "and" should read --and an--.

COLUMN 3
Line 58, "are each" should read --each are--.

COLUMN 4
Line 67, "23d" should read --23d,--.

COLUMN 6
Line 22, "165°" should read --165°,--.
Line 43, "{$L_2$" should read --$\Delta L_2$--.

COLUMN 9
Line 35, "a" should be deleted.

Signed and Sealed this

Tenth Day of May, 1994

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,216,475

DATED : June 1, 1993

INVENTOR(S) : AKIO ONO

It is certified that error appears in the above-indentified patent and that said Letters Patent is hereby corrected as shown below:

On the title page, item [73], "Kabushika" should read --Kabushiki--

Signed and Sealed this

Fifteenth Day of November, 1994

*Attest:*

*Attesting Officer*

BRUCE LEHMAN

*Commissioner of Patents and Trademarks*